US009365335B2

(12) United States Patent
Burgess et al.

(10) Patent No.: US 9,365,335 B2
(45) Date of Patent: Jun. 14, 2016

(54) CLOSURE CAP FOR A CONTAINER

(71) Applicant: Incap International Ltd., Hong Kong (CN)

(72) Inventors: Michael Sean Burgess, Tulbagh (ZA); Axel Hauck, Kirchentellinsfurt (DE)

(73) Assignee: Incap International Ltd., Hong Kong (CN)

( * ) Notice: Subject to any disclaimer, the term of this patent is extended or adjusted under 35 U.S.C. 154(b) by 0 days.

(21) Appl. No.: 14/420,454

(22) PCT Filed: Aug. 9, 2013

(86) PCT No.: PCT/EP2013/066692
§ 371 (c)(1),
(2) Date: Feb. 9, 2015

(87) PCT Pub. No.: WO2014/023818
PCT Pub. Date: Feb. 13, 2014

(65) Prior Publication Data

US 2015/0217914 A1 Aug. 6, 2015

(30) Foreign Application Priority Data

Aug. 9, 2012 (DE) ..... 20 2012 007 857 U

(51) Int. Cl.
*B65D 51/28* (2006.01)

(52) U.S. Cl.
CPC ..... *B65D 51/2857* (2013.01); *B65D 51/2835* (2013.01); *B65D 2101/0076* (2013.01)

(58) Field of Classification Search
CPC ..... B65D 51/222; B65D 51/2807; B65D 51/2814; B65D 51/2828; B65D 51/2835; B65D 51/2857; B65D 51/2864; B65D 51/226; B65D 51/227
See application file for complete search history.

(56) References Cited

U.S. PATENT DOCUMENTS

| | | | | |
|---|---|---|---|---|
| 4,865,189 | A | 9/1989 | Guerra et al. | 206/221 |
| 7,614,496 | B2 * | 11/2009 | Dvorak | B65D 51/2835 206/219 |

(Continued)

FOREIGN PATENT DOCUMENTS

| | | | |
|---|---|---|---|
| EP | 0 377 412 | 1/1989 | B65D 51/28 |
| EP | 2 481 681 | 8/2012 | B65D 51/28 |
| JP | 2006-69636 | 3/2006 | B65D 51/28 |

(Continued)

OTHER PUBLICATIONS

International Search Report from corresponding International Patent Application No. PCT/EP2013/066692, dated Nov. 5, 2013.
International Preliminary Report on Patentability for corresponding International Patent Application No. PCT/EP2013/066692, dated Jul. 21, 2014.

*Primary Examiner* — Anthony Stashick
*Assistant Examiner* — Mollie Llewellyn
(74) *Attorney, Agent, or Firm* — Kusner & Jaffe

(57) ABSTRACT

A closure cap for a container, said closure cap having a cap housing including a substantially cylindrical recess which has a top opening and a bottom opening, wherein the bottom opening is closed by means of a piercable membrane, a plunger comprising a cover and a substantially cylindrical lateral surface extending downward from an underside of the cover, wherein the lateral surface engages in the top opening of the recess and has an outside diameter corresponding substantially to the inside diameter of the recess, and a chamber defined by the cylindrical recess and the plunger which engages in the recess by way of its lateral surface, the plunger and the cap housing being movable relative to one another between a first, non-active position, and a second, activated position.

14 Claims, 3 Drawing Sheets

(56) References Cited

U.S. PATENT DOCUMENTS

| | | | | |
|---|---|---|---|---|
| 9,085,397 | B2 * | 7/2015 | Maas | A61J 1/2089 |
| 2003/0213709 | A1 | 11/2003 | Gibler et al. | 206/219 |
| 2011/0068102 | A1 | 3/2011 | Porter | 220/212 |

FOREIGN PATENT DOCUMENTS

| | | | |
|---|---|---|---|
| WO | WO 2006/052827 | 5/2006 | B65D 25/08 |
| WO | WO 2008/048077 | 4/2008 | B65D 51/28 |
| WO | WO 2009/055311 | 4/2009 | B65D 51/28 |

* cited by examiner

CLOSURE CAP FOR A CONTAINER

FIELD OF THE INVENTION

The present invention relates to a closure cap for a container and to a container provided with a closure cap of this type. The invention relates, in particular, to a closure cap for a container, which closure cap, in its interior, has a chamber in which a substance, for example an active substance, is kept separated from the rest of the interior of the container and, when required, in particular directly prior to use, is able to be discharged into the interior of the container. The closure cap can be used with a vast variety of containers, including bottles, drinking glasses, bowls, beakers, tumblers and the like.

BACKGROUND OF THE INVENTION

A plurality of substances, for example medicines or food additives such as vitamins, proteins, anti-oxidants or even vegetable additives, as an aqueous solution, aqueous suspension or emulsion have a potency that decreases rapidly with time. In particular in the area of sport and wellbeing, these types of products are preferably commercialised in liquid form, often in pre-packaged beverage bottles. As a result of the unavoidable transport and storage times, in the majority of cases these types of beverages no longer provide the consumer with the originally desired effect or only provide it in a limited manner. Many of the above-described substances, however, maintain their initial properties very well in dried form, for example as capsules, pastilles, tablets, pills, granulate or powder without forfeiting their original potency. Consequently there are already beverage containers on the market which have at least two separate chambers, one chamber containing the liquid and the other chamber containing the actual active substance in dried form or as a concentrated liquid or paste. Not until directly prior to use are the contents of the two chambers mixed and the beverage consumed. In the case of a variant of these types of beverage bottles, the substance, which is typically dried or is present in concentrated form, is situated in a chamber provided in the closure cap, whilst the liquid which makes up the main proportion of the beverage is situated in a conventional manner in the main container.

US patent application US 2003/0213709 A1 describes a beverage storage and discharge cap assembly, which includes an inner cylindrical housing rotatably nested within an outer cylindrical housing, the outer housing including a cap skirt having threads capable of being rotatably coupled to the neck of a bottle. The housings are hollow such that the inner housing may store a beverage substance therein, the inner housing having a closed top and the outer housing having a bottom wall for sealing the beverage substance within the cap assembly. A rotation of the inner housing causes a free edge thereof to rupture the bottom wall, thus releasing the stored beverage substance into the bottle whereby to interact with a beverage substance in the bottle. The housings include cooperating nubs that produce an audible sound or "pop" substantially simultaneous with rupture of the seal.

U.S. Pat. No. 4,865,189 A describes a device for storage, mixing and dispensing of two separate materials, including but not limited to liquids, semi-liquids, powders, and granulated materials. The first and second containers include neck portions which are matably slidable within one another, the necks defining openings into each container. A plug member is retentively held in the neck of either container, and extends to a stopper portion which blocks fluid flow through the neck of the one container when it is positioned in the neck of the other container, thus separating the two materials during storage. A sleeve extends over the second container and at least a portion of the first container. A removable collar can be positioned between the second container and the first container to hold them in position where the materials are separated for storage. By removal of the collar, the first which moves the stopper portion out of the sealing position and allows communication between the containers for mixing. The second container can also include an opening sealingly closed by a second plug which allows a needle, cannula or other conduit to be inserted therethrough to withdraw the mixed fluids for dispensing.

European paten application EP 377412 A1 describes a double-chambered container for liquids comprising a container on which a sealing member can be screwed, the sealing member showing a removable, disposable bottom and which is able in turn to receive tightly an open bottomed tubular cartridge so that a hermetically closed chamber is formed. The tubular cartridge is also equipped with a cap ending with a removable safety ring. Tearing off the safety ring, the removable disposable bottom of the sealing member can be removed, connecting the chamber formed by the tubular cartridge and by the sealing member with the container. The container according to EP 377412 A1 is particularly suitable for tightly preserving liquids to be mixed upon use.

International patent application WO 2009/055311 A1 describes a sealed reservoir cap for attaching to a bottle which includes an annular part slidably received into another annular part to define an enclosed reservoir therebetween that is closed off by a punchable seal.

Japanese patent application JP 2006 069 636 A describes a sealed container with a bottom lid prevented from falling off from an outer cylinder even if a bottom lid is opened. An outer cylinder of the sealed container is closed by the bottom lid, the bottom face of which can be opened through a thin-wall part. The lower part of its inner circumferential surface is provided with an annular protrusion, the upper end of its outer circumferential surface is provided with a male thread and an engagement flange is set below it. The inner cylinder is provided with a reduced diameter part and its opened lower end surface is inclined, its edge part is made to function as a pressing part while its upper end surface is closed by a lid having a female thread screwed on the male thread of the outer cylinder. A restricting ring is removably attached to the lower end edge of the lid, the female thread is screwed on the male thread and the lid is rotated in its tightening direction. The upper portion above the outer reduced diameter part of the inner cylinder is closely connected with the annular protrusion of the outer cylinder to form a sealed state, and further when the lid is rotated in this direction, the thin-wall part is depressed with the pressing part and broken and the bottom lid is opened with leaving the part partially unbroken International patent application WO 2008048077 A1 describes a container cap allowing the addition of an adjunct. The container cap includes a base cap member, which is a lower cap body coupled to a neck part of a container, an operational cap member, which is an upper cap body coupled to the upper end of the base cap member, and an openable sheet, which is provided on the lower end of one selected from the base cap member and the operational cap member. The openable sheet is able to be cut to discharge the adjunct. The container cap further includes a cutting means for cutting the openable sheet. The cutting means is provided in a remaining one selected from the base cap member and the operational cap member at a position corresponding to the openable sheet. The openable sheet includes a weight member, which has a diameter less than a diameter of an arc part of the openable sheet to be cut. A connection rib is connected between the weight member and a lower edge of an adjunct receiving part of the base cap member. The openable sheet further includes an openable sealing film, which seals both the lower edge of the adjunct receiving part and the weight member.

Finally, a multi-chamber container of this type with a corresponding closure cap is described, for example, in International Patent Application WO 2006/052827 A. The closure cap described in said document has an outer cap housing and an inner plunger which surrounds a chamber in which the substance to be protected from liquid and moisture during storage is situated prior to use. The bottom of the plunger forms a valve plate which can be pushed downward by pressing the plunger down in order to release a passage of the substance into the interior of the container in this manner. A circumferential locking ring, which has to be removed prior to use, ensures the plunger cannot be unintentionally actuated prior to use. The closure cap described in said document is expensive to produce and not very intuitive to use as a result of the numerous individual parts.

Consequently, the technical problem underlying the present invention is to provide a closure cap for a container, said closure cap having an inner chamber in which a substance to be protected is able to be kept protected from environmental influences during storage and prior to use is able to be discharged into a container which is provided with the closure cap by means of a clear, easily understood activating mechanism. The closure cap according to the invention, in this case, is to be producible in a particularly simple and cost-efficient manner.

SUMMARY OF THE INVENTION

Said technical problem is solved by the closure cap according to the independent claims(s). Advantageous further developments of the invention are the objects of the dependent claims.

Said technical problem is solved by the closure cap according to accompanying claim 1. Advantageous further developments of the invention are the objects of the dependent claims.

Accordingly, the invention relates to a closure cap for a container, said closure cap having a cap housing which includes a substantially cylindrical recess which has a top opening and a bottom opening, wherein the bottom opening is closed by means of a piercable membrane, a plunger which comprises a cover and a substantially cylindrical lateral surface which extends downward from an underside of the cover, wherein the lateral surface engages in the top opening of the recess of the cap housing and has an outside diameter which corresponds substantially to the inside diameter of the recess, and a chamber which is defined by the recess of the cap housing and the plunger which engages in the recess by way of its lateral surface, the plunger and the cap housing being arranged so as to be movable relative to one another between a first, non-active position, in which a bottom edge of the lateral surface is arranged above the membrane of the cap housing and in which the plunger is blocked from being vertically pressed into the recess of the of the cap housing, and a second, activated position, in which the bottom edge of the lateral surface pierces the membrane, wherein the plunger is movable by means of an essentially rotational movement from the first, non-active position into an intermediate position where the plunger is allowed to be pressed into the recess so as to reach the second, activated position.

The closure cap according to the invention is consequently designed in a particularly simple manner, for the chamber is essentially formed just by two components which are fitted into one another and are substantially U-shaped or in the form of an inverted U. The bottom of the one U-shaped housing part, in this case, closes the piercable bottom opening of the chamber, whilst the edge of the inverted U-shaped housing part is able to pierce said bottom when the closure cap is activated. The walls of the two U-shaped components lying closely together form effective sealing of the chamber interior in relation to the surrounding area such that the substance located in the chamber is protected from harmful environmental influences right up until activation.

In its first non-active position, the plunger is mechanically prevented from being depressed into the second activated position. When the closure cap is activated, the plunger is initially moved from the first, non-active position into an intermediate position by means of an essentially rotational movement. In the intermediate position, the plunger is no longer blocked in its translational movement and can therefore be pressed into the recess to reach the second, activated position. The movement from the intermediate position into the second, activated position is preferably an essentially translational movement which is initiated by pushing or pressing the cap. It can, howver, also be a combined rotational and translational movement with reference to the cap housing.

In a preferred embodiment, the rotational and/or the translational movement is established by the shaping of the cap housing and of the plunger with respect to one another. According to one preferred variant, the plunger has a skirt with a bottom edge which abuts at least in part against a top edge of an outer sleeve of the cap housing. In this case, the bottom edge of the skirt and the top edge of the outer sleeve are profiled in such a manner that in the initial non-active position a translational movement of the plunger is blocked and only a rotation of the plunger into the intermediate position enables a translational movement of the plunger into the recess of the cap housing. In contrast to the prior art known from WO 2006/052827, the closure cap according to the invention consequently does not require a separate locking ring. In the non-active position, the profiling of the cap housing and of the plunger prevent an inadvertent downward actuation of the plunger and consequently prevent a piercing of the membrane. The user can therefore only produce an actuation, namely a pressing down of the plunger and consequently a piercing of the membrane, by means of initially rotating the plunger into the intermediate position. During the storage and the transporting of a container provided with such a closure cap, unintentional rotation of the plunger in relation to the cap housing is considerably less likely than unintentional pressing down such that reliable activation protection is ensured even without further safety measures. Where required, however, other protection mechanisms can also be provided. For example, the cap housing and the plunger can be provided with an easily removable protective sleeve or cap. As an alternative to this, the bottom edge of the skirt and the top edge of the outer sleeve can be connected together by one or several breakable weld points or connecting webs which can be broken easily when the plunger is rotated in a conscious manner. In one preferred embodiment, a breakable security web is provided in a guide groove of the cap. The weld points or webs are broken when the cap is turned into its intermediate position and can therefore act as a tamper evidence.

According to a preferred variant, the bottom edge of the skirt of the plunger has a nose which abuts against a raised edge of the top edge of the outer sleeve in the first, non-active position and engages in an indentation which is formed by the top edge of the outer sleeve in the second, activated position. The nose sliding into the indentation then enables the plunger to move downward such that the membrane is able to be pierced.

In order to ensure a clear and unambiguous sequence of movement, at the level of the indentation a vertically extending groove can be provided in an outside wall of the cylindrical recess of the cap housing, in which groove a projection which is formed on the inside surface of the nose is able to engage when the plunger has been rotated so far out of its non-active position that it is located above the indentation. Through the noticeable latching of the projection in the vertically extending groove, the user notices that the correct position has been achieved in order to press the plunger down into the cap housing in order to pierce the membrane in this manner. Said sequence of handling can be made even clearer by means of corresponding arrows and/or numbers on the outside surface of the closure cap. It is precisely in the first, non-active position that the projection which is realized on the inside surface of the nose is able to engage in a bore which is provided on the outside wall of the cylindrical recess in order, in this way, to ensure an anti-twist means in the first, non-active storage position. The user then has to rotate the plunger using an initially slightly increased force so that the nose is able to slide out of the bore and the plunger can continue to be rotated until the nose finally latches into the vertical groove.

Additional guiding means can be provided in addition to the guiding of the movement of the plunger which is ensured precisely by the suitable profiling of the skirt of the plunger and of the outer sleeve of the cap housing. For example, a guide pin, which engages in a guide groove which is recessed in the skirt of the cap, can be provided on an outside wall of the cylindrical recess. The guide groove can be in the form of a horizontal L, for example, such that the sequence of the movements, namely an essentially horizontal rotating of the plunger, followed by a pressing down of the plunger into the cap housing, is ensured precisely by the form of the guide groove.

If the bottom edge of the lateral surface of the plunger horizontally even over its circumference, i.e. at the level with respect to the cap housing, the membrane is perforated essentially at the same time over its entire circumference. In the case of a variant of this type there is the risk of the membrane falling into the interior of the container, which is unwanted in the majority of applications. Consequently, the bottom edge of the lateral surface preferably has at least one point which is directed toward the membrane and is located geodetically lower than the remaining bottom edge such that when the plunger is pressed downward, the membrane is perforated at this position first of all. The bottom edge of the lateral surface can be curved upward starting from the point such that when the plunger is pressed downward, the perforation of the membrane spreads out on both sides along the circumference starting from the position pierced by the point. The profile of the bottom edge can then be selected such that, for example, on the side opposite the point, the bottom edge of the lateral surface is set back so far that even when the plunger is pressed downward to its maximum, i.e. until, for example, the nose of the skirt of the plunger abuts against the underside of the indentation of the outer sleeve of the cap housing, there is no more perforating. Consequently, the membrane remains connected to the cap housing at this position and is no longer able to fall into the interior of the container.

In addition, it is possible to provide means which effectively promote the opening of the perforated membrane so that the substance located in the interior of the chamber is able to be discharged into the interior of the container in a reliable and total manner once the membrane has been perforated. To this end, a wedge-shaped projection, which interacts with a complementary projection provided on the top surface of the membrane when the plunger is pressed downward in the direction of the membrane, can be realized, for example, on the inside surface of the lateral surface in order, by means of a type of lever effect, to assist the swinging open of the membrane which is perforated by the bottom edge of the lateral surface of the plunger.

The closure cap according to the invention can be connected to the container in a diverse manner. In the case of a container where the bottle neck thereof has an external thread, the cap housing can have an internal thread, for example, for fastening the closure cap on the container in a detachable manner.

Once the closure cap has been activated, the substance located in the interior of the chamber being discharged into the interior of the container and being mixed with the liquid located there, the closure cap is consequently able to be unscrewed totally from the container such that the resultant mixture, for example the vitamin drink or the like, is able to be consumed. A ribbing, a rubber coating or a wrinkling of the surface, for example, can be provided on the outside of the cap housing in order to make it easier to unscrew the closure cap from the container.

According to a preferred variant, the cap housing of the closure cap is connected to a locking ring by means of several thin webs in order to ensure the integrity of the container. When unscrewing the closure cap from the container, the webs are broken and the locking ring is fixed on the bottle neck in such a manner that it remains on the container. When the closure cap is screwed on again, the breached webs are then also an indication that the container is no longer in the intact original state.

According to another embodiment, the cover of plunger is provided with a straw or has means for inserting a straw. Such means my comprise a breakable seal on the cover an a guiding rim through which a straw can be inserted. In this embodiment, the mixed liquid in the container can be consumed without having to remove the cap of the invention.

The cap housing can consist at least in part of a transparent or translucent material such that the lateral surface of the plunger remains visible in order to provide additional information regarding the method of operation of the closure cap. According to another variant, the lateral surface of the plunger is also transparent or translucent such that the substance located in the interior of the chamber can be seen.

There are no limits to the types of substances which are able to be filled into the chamber of the closure cap. In a particularly preferred manner, however, the closure cap according to the invention is used for beverage bottles such that the substance can be a health-promoting active substance, for example.

In a particularly preferred manner, the cap housing and the plunger are each realized as an integral moulded part, e.g. by injection moulding, such that the closure cap is able to be produced in a particularly favourable manner.

The invention also relates to a container which is provided with a closure cap according to the invention of the above-mentioned type. The closure cap of the invention can be used with a variety of containers such as bottles, drinking glasses, bowls, beakers, tumblers, jars, tubes and the like. A variety means for attaching the cap to the container with sufficient security can be used, including threads, lugs, hinges, locks, adhesives, etc. In those cases where a removable closure cap is required, thread caps will usually be preferred. The closure cap can have an internal thread for cooperating with the usual external thread of bottles. In some cases, the cap may have an external thread for cooperating with an internal thread of a drinking glass or tumbler. In this variant, the drinking glass or tumbler presents a smooth outer rim once the closure cap is removed.

The closure cap of the invention can be made from a variety of materials, preferably from a plastic material. The closure cap can exhibit a certain flexibility to adjust to slight manufacturing variation in the container and the closure structure and to maintain a liquid and/or gas tight seal. In addition or alternatively, the cap can be provided with gaskets such as O-rings or closure liners to provide for the seal.

BRIEF DESCRIPTION OF THE DRAWINGS

The invention is explained below in more detail by way of exemplary embodiments shown in the accompanying drawing.

The drawing is as follows.

DETAILED DESCRIPTION OF THE INVENTION

Figure 1:
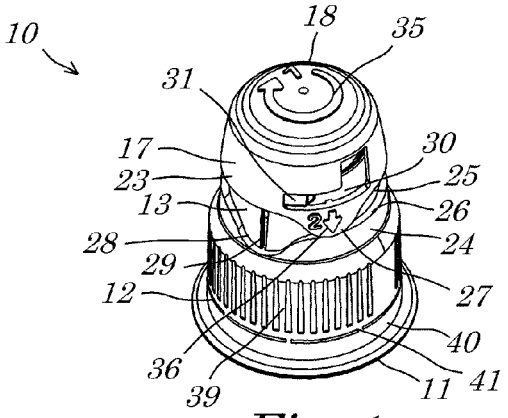
FIG. 1 shows a perspective view of the closure cap according to a first embodiment of the invention in the first, non-active position (storage position)
Figure 2:
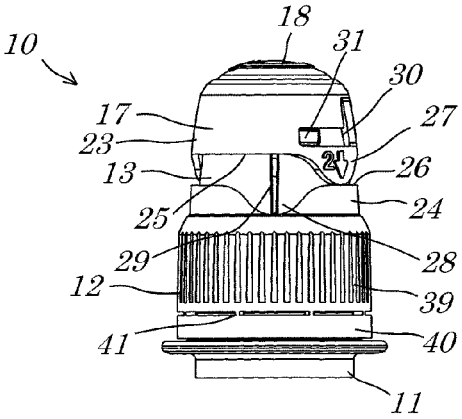
FIG. 2 shows a side view of the closure cap of FIG. 1 in the first, non-active position.
Figure 3:
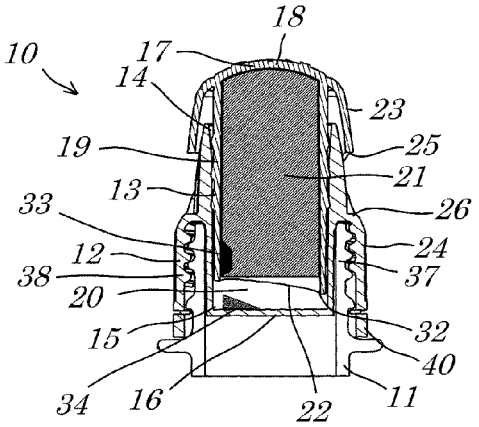
FIG. 3 shows a cross section through the closure cap of FIG. 1 in the first, non-active position.

The closure cap according to a first embodiment of the invention is shown in the first, non-active position in FIGS. 1 to 3.

The closure cap, designated overall by the reference numeral 10, is fastened on a bottle neck 11 of a container, which for reasons of better clarity is not shown any further. The closure cap 10 includes a cap housing 12 which has a substantially cylindrical recess 13 which has a top opening 14 and a bottom opening 15. The bottom opening 15 is closed by means of a piercable membrane 16 such that the recess 13 is realised overall in a U-shaped manner. A plunger 17, which includes a cover 18 and a cylindrical lateral surface 19 which extends downward from the underside of the cover 18, is inserted into the recess 13. The lateral surface 19 engages in the top opening 14 of the recess 13. As can be seen in particular from the cross sectional representation in FIG. 3, the outside diameter of the lateral surface 19 corresponds substantially to the inside diameter of the cylindrical recess 13, such that the lateral surface 19 abuts closely against the inside wall of the recess 13. The cylindrical lateral surface 19 and the cover 18 of the plunger are essentially in the form of an inverted U. The plunger which engages in the recess of the cap housing and the recess of the cap housing consequently form a closed chamber 20, in which a substance 21 is located. The plunger 17 and the cap housing 12 are movable toward one another in a rotational and translational manner such that the plunger 17 is able to be moved from the first, non-active position shown in FIGS. 1 to 3 into the second, activated position shown in FIGS. 4 to 6. In the first, non-active position, the bottom edge 22 of the lateral surface 19 is situated above the membrane 16 such that the chamber 20 is closed.

To ensure the rotational and translational movement, the plunger 17 has a skirt 23 which essentially is an downward extension of the cover 18. The cap housing 12 also has an outer sleeve 24 which surrounds the recess 13 over part of its height. The bottom edge 25 of the skirt 23 and the top edge 26 of the outer sleeve 24 are profiled such that in the first, non-active position shown in FIGS. 1 to 3 the plunger 17 is not able to be pressed downward into the interior of the cap housing such that there is no risk of piercing the membrane 16. Rathermore, the plunger has first to be rotated so that the plunger 17 is able to be pressed downward into the cap housing 12. To this end, in the example shown, the skirt 23 has a nose 27 which abuts against the raised edge of the top edge 26 of the outer sleeve 24 in the first, non-active position. Once the plunger 17 has been rotated, the nose 27 can be pressed downward into an indentation 28 which is formed by the top edge 27 of the outer sleeve 24. So that the user notices how far he has to rotate the plunger 17, a vertically extending groove 29 is provided in the outside wall of the recess 13, into which groove a projection which is provided on the inside surface of the nose 27 is able to engage when the nose is situated above the indentation 28. The projection cannot be seen in the Figures. In addition, in the case of the depicted embodiment of the closure cap according to the invention, an L-shaped guide groove 30 is provided in the skirt 23 into which a guide pin 31 which is provided on the outside wall of the recess 13 engages. The horizontal portion of the L consequently defines the horizontal rotatability of the plunger 17, whilst the vertical portion of the L of the guide groove 30 defines the vertical mobility of the plunger 17. Over and above this, the indentation 28 forms a stop for the nose 27 of the plunger.

The bottom edge 22 of the lateral surface 19 of the plunger 17, as can be seen in particular in FIG. 3, is profiled in such a manner that a point 32 is created which is directed towards the membrane 16. When the plunger 17 is pressed downward, for example by pressing or tapping on the cover 18, the membrane 16 is perforated first of all by the point 32. A wedge-shaped projection 33 is provided on the inside wall of the lateral surface 19 in order to facilitate the folding back of the part-perforated membrane 16. To this effect, when the plunger 17 is pushed downward in the direction of the membrane 16, the wedge-shaped projection 33 interacts in the manner of a lever with a projection 34 which is provided on the top surface of the membrane 16.

As can be seen in particular in FIG. 1, markings 35, 36 (in the present embodiment arrows and numbering to clarify the sequence of rotation and translation) have been applied to the surface of the plunger 17.

To activate the closure cap according to the invention, the plunger 17 is rotated in the direction of the arrow marking 35 (i.e. clockwise) until the projection which is realized on the inside surface of the nose 37 latches into the vertical groove 29. The plunger 17 is then pressed downward by means of pressure or a light tap on the cover 18 so that the bottom edge 22 of the lateral surface 19 is able to pierce the membrane 16. As a result of the profiling of the bottom edge 22, which can be seen in FIG. 3, the membrane on the side opposite the point 32 is not completely severed, but remains connected to the bottom opening 15 of the recess 13. The projections 33 and 34 ensure, however, that the part-perforated membrane is folded back down completely, such that the substance 21 located in the interior of the chamber 20 is able to escape downwardly.

Figure 4:
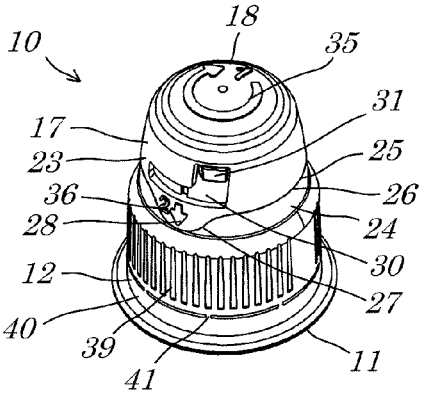
FIG. 4 shows a perspective view corresponding to FIG. 1 of the closure cap according to the first embodiment of the invention in the second, activated position.
Figure 5:
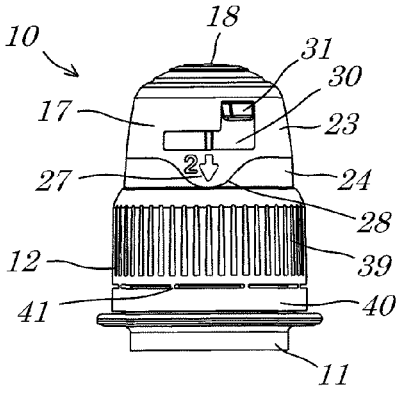
FIG. 5 shows a view corresponding to FIG. 2 of the closure cap according to the first embodiment of the invention in the second, activated position.
Figure 6:
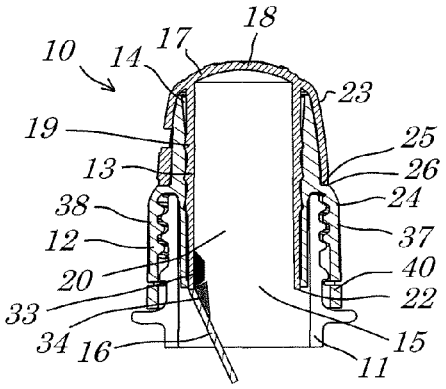
FIG. 6 shows a cross section corresponding to FIG. 3 of the closure cap according to the first embodiment of the invention in the second, activated position.

FIGS. 4 to 6 show the closure cap according to the first embodiment of the invention in the correspondingly activated state. In said state, the nose 27 is situated in the indentation 28 and the guide pin 31 has reached the opposite end of the guide groove 30.

In the example shown, the container neck 11 has an external thread 37. Accordingly, the cap housing 12 is provided with an internal thread 38 for fastening the closure cap 10 on the container neck 11 in a detachable manner. Once the closure cap 10 has been activated, the entire closure cap can consequently be unscrewed from the container neck 11. For this purpose, the outer sleeve 24 of the cap housing 12 has a ribbing 39 which makes it possible to grasp and rotate the closure cap more easily.

In the example shown, the closure cap additionally has a locking ring 40, which is fixed on the container neck 11 and is connected to the cap housing 12 by means of thin webs 41. When the closure cap is unscrewed, the webs 41 break and consequently show that the container is no longer in the original intact state. The locking ring 40, in this case, is non-rotatably connected to the container neck 11.

In FIGS. 7 to 11, a second embodiment 110 of the closure cap of the invention is shown. The second embodiment of the closure cap essentially corresponds to the closure cap of FIGS. 1 to 6. Most elements of the embodiment of FIGS. 7 to 11 are correspond to elements of the embodiment of FIGS. 1 to 6 and, if at all, are therefore denoted by the same reference sign and are not described in detail again. Elements which have been changed with respect to the first embodiment are denoted by the same reference number increased by 100. In contrast to the first embodiment, the neck 11 of the bottle onto which the closure cap of the invention is fixed, is not shown in FIG. 7 and following.

Figure 7:
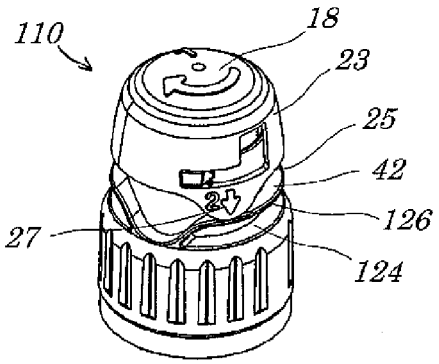
FIG. 7 shows a perspective view of the closure cap according to a second embodiment of the invention in the first, non-active position (storage position)
Figure 8:
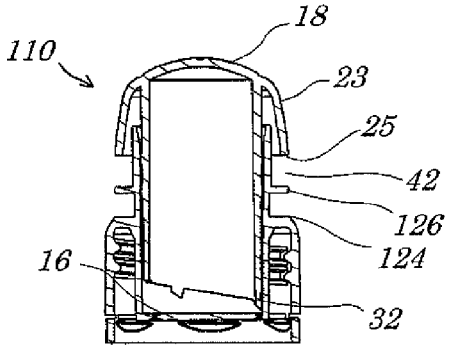
FIG. 8 shows a cross section through the closure cap of FIG. 7 in the first, non-active position.
Figure 9:
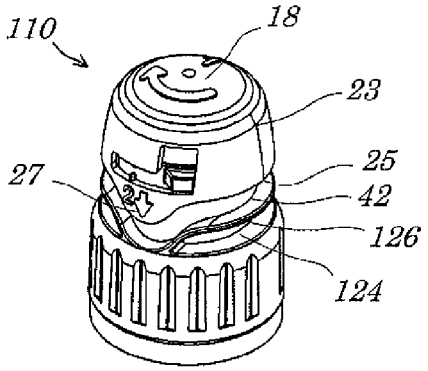
FIG. 9 shows a perspective view corresponding to FIG. 7 of the closure cap according to the second embodiment of the invention in the intermediate position.
Figure 10:
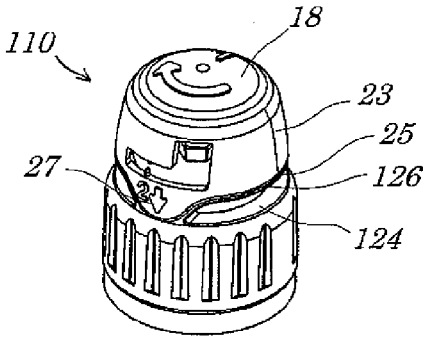
FIG. 10 shows a perspective view corresponding to FIG. 7 of the closure cap according to the second embodiment of the invention in the second, activated position.
Figure 11:
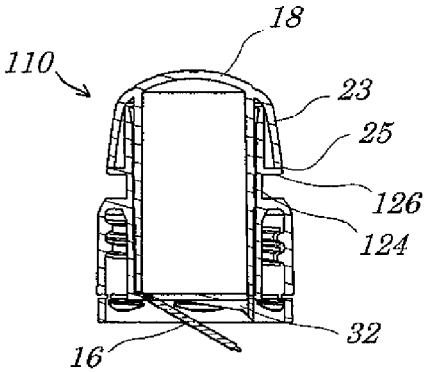
FIG. 11 shows a cross section corresponding to FIG. 8 of the closure cap according to the second embodiment of the invention in the second, activated position.

FIG. 7 shows a perspective view of the closure cap 110 according to the second embodiment of the invention in the first, non-active position (storage position). In order to avoid thick material condition and sink marks over internal seals, the sleeve 124 has been made thinner. As compared to the first embodiment, the overall wall thickness has been reduced to facilitate activation by providing the sidewalls with more flexibility to allow seals to pass through. This also facilitates ejection from the tool. Further material costs and production cycle time have been reduced. In order to still provide a reliable end stop for the bottom edge 25 of skirt 23, the top edge 126 of sleeve forms a radially outwardly extending rim. FIG. 8 shows a cross section through the closure cap 210 in the first, non-active position. FIG. 9 shows a perspective view corresponding to FIG. 7 of the closure cap 210 in the intermediate position. FIG. 10 shows a perspective view corresponding to FIG. 7 of the closure cap 210 in the second, activated position. FIG. 11 shows a cross section corresponding to FIG. 8 of the closure cap 210 in the second, activated position. In the first non-active of FIGS. 7 and 8 and in the intermediate position of FIG. 9, there is a space 42 between the bottom edge 25 of skirt 23 and the rim-like top edge 126 of sleeve 124. As can be taken from FIGS. 10 and 11, in the second, activated position, the bottom edge 25 of skirt 23 abuts against the rim-like top edge 126 of sleeve 124.

Figure 12:
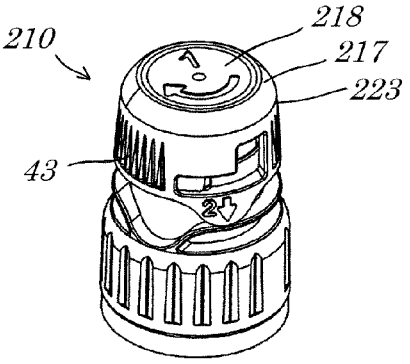
FIG. 12 shows a perspective view of the closure cap according to a third embodiment of the invention in the first, non-active position (storage position)
Figure 13:
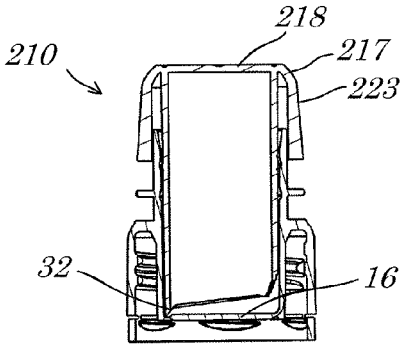
FIG. 13 shows a cross section through the closure cap of FIG. 12 in the first, non-active position.
Figure 14:
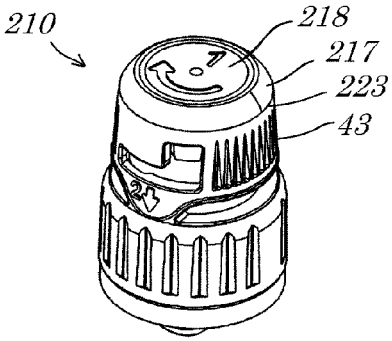
FIG. 14 shows a perspective view corresponding to FIG. 12 of the closure cap according to the third embodiment of the invention in the second, activated position.
Figure 15:
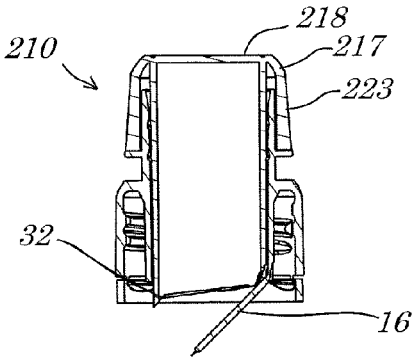
FIG. 15 shows a cross section corresponding to FIG. 13 of the closure cap according to the third embodiment of the invention in the second, activated position.

In FIGS. 12 to 15, a third embodiment 210 of the closure cap of the invention is shown. The third embodiment of the closure cap essentially corresponds to the closure cap of FIGS. 1 to 6 and FIGS. 7 to 11, respectively. Most elements of the embodiment of FIGS. 12 to 15 correspond to elements of the embodiment of FIGS. 1 to 6 and, if at all, are therefore denoted by the same reference sign and are not described in detail again. Elements which have been changed with respect to the first embodiment are denoted by the same reference number increased by 200. FIG. 12 shows a perspective view of the closure cap 210 in the first, non-active position (storage position). FIG. 13 shows a cross section through the closure cap 210 of FIG. 12 in the first, non-active position. FIG. 14 shows a perspective view corresponding to FIG. 12 of the closure cap according to the third embodiment of the invention in the second, activated position. FIG. 15 shows a cross section corresponding to FIG. 13 of the closure cap according to the third embodiment of the invention in the second, activated position. The third embodiment 210 essentially corresponds to the second embodiment 110 but the plunger 217 is provided with flat cover 218 in order simplify the design of the filling and assembly machine, as well as the actuation of the plunger. Further, the side walls of the skirt 223 of plunger 217 are thicker, thus providing for a heavier punger which prevents premature activation under load. The tighter fit between cap housing 212 and plunger base and top prevents over rotation when moving from the in-activated (locked) to the intermediate (unlocked) state. Consequently, while still useful, the groove 29 of the first embodiment is no longer required. Finally, the closure cap 210 of the third embodiment is provide with side grippers 43 on the plunger 217 in addition to the ribbing 39 provided on the cap housing 212 in order to improve user interaction. Overall, the closure cap of the third embodiment provides a more aesthetically balanced product.

Figure 16:
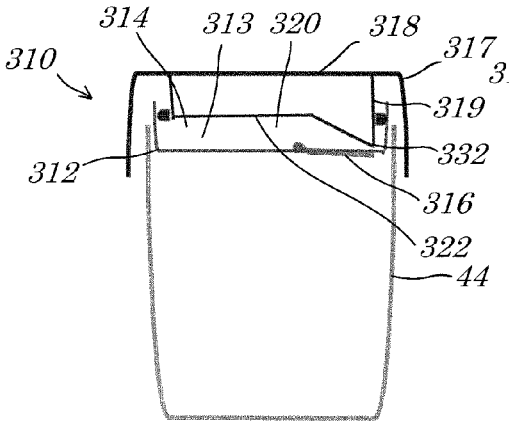
FIG. 16 shows a cross sectional view of a tumbler provided with a closure cap according to a forth embodiment of the invention in the first non-active position (storage position)
Figure 17:
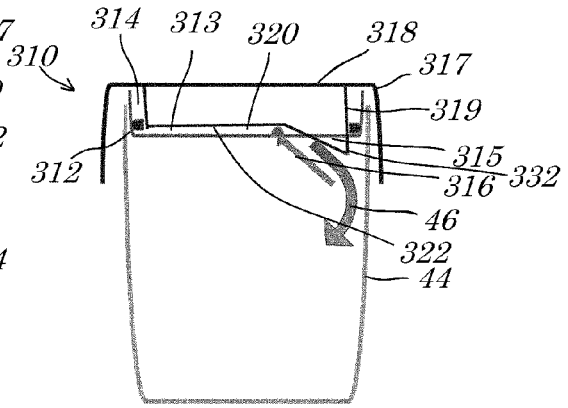
FIG. 17 shows a cross sectional view of a tumbler of FIG. 16 with the closure cap in the second, activated position.

In FIGS. 16 and 17, a forth embodiment 310 of the closure cap of the invention is shown. Elements which have a similar function as elements descried in the previous embodiments are denoted by the same reference sign but increased by 300. FIG. 16 shows a very schematic cross sectional view of a tumbler 44 provided with the closure cap 310 in the first non-active position (storage position) and FIG. 17 shows a cross sectional view of the tumbler 44 of FIG. 16 with the closure cap 310 in the second, activated position. The activation mechanism of the closure cap 310 essentially corresponds to the turning and pressing activation mechanism described in more detail in connection with the closure caps of the first, second and third embodiment. Essentially, the closure cap 310 is fastened on the tumbler 44. The closure cap 310 includes a cap housing 312 which has a substantially cylindrical recess 313 which has a top opening 314 and a bottom wall 45 such that the recess 313 is realized overall in a U-shaped manner. The bottom wall is provided with a bottom opening 315. The bottom opening 315 is closed by means an a piercable membrane 316. A plunger 317, which includes a cover 318 and a cylindrical lateral surface 319 which extends downward from the underside of the cover 318, is inserted into the recess 313. The lateral surface 319 engages in the top opening 314 of the recess 313. The cylindrical lateral surface 319 and the cover 318 of the plunger are essentially in the form of an inverted U. The plunger which engages in the recess of the cap housing and the recess of the cap housing consequently form a closed chamber 320, in which a substance (e.g. liquid, granules, powder) can be stored until use. is located. The plunger 317 and the cap housing 312 are again movable toward one another in a rotational and translational manner such that the plunger 317 is able to be moved from the first, non-active position shown in FIG. 16 into the second, activated position shown in FIG. 17.

The bottom edge 322 of the lateral surface 319 of the plunger 317 is profiled in such a manner that a point 332 is created which is directed towards the membrane 316. When the plunger 317 is pressed downward, the membrane 316 is perforated by the point 332 such that the substance located in the interior of the chamber 320 is able to escape downwardly into the tumbler 44 (c.f. arrow 46 in FIG. 17).

Having described the invention, the following is claimed:

1. Closure cap for a container, said closure cap comprising:

a cap housing which includes a substantially cylindrical recess which has a top opening and a bottom opening, wherein the bottom opening is closed by means of a membrane, a plunger which comprises a cover and a substantially cylindrical lateral surface which extends downward from an underside of the cover, wherein the lateral surface engages in the top opening of the recess of the cap housing and has an outside diameter which corresponds substantially to the inside diameter of the recess, and a chamber which is defined by the recess of the cap housing and the plunger which engages in the recess by way of its lateral surface, the plunger and the cap housing being arranged so as to be movable relative to one another between a first, non-active position, in which a bottom edge of the lateral surface is arranged above the membrane of the cap housing and in which the plunger is blocked from being vertically pressed into the recess of the cap housing, and a second, activated position, in which the bottom edge of the lateral surface opens the membrane, wherein the plunger is movable by means of an essentially rotational movement from the first, non-active position into an intermediate position where the plunger is allowed to be pressed into the recess so as to reach the second, activated position, and wherein the plunger is movable from the intermediate position into the second, activated position by means of a translational or a combined rotational and translational movement with reference to the cap housing, the plunger having a skirt with a bottom edge which abuts at least in part against a top edge of an outer sleeve of the cap housing, wherein the bottom edge of the skirt and the top edge of the outer sleeve each have a profile, wherein the profile of the bottom edge of the skirt and the profile of the to edge of the outer sleeve engage in such a manner that a rotation of the plunger enables a translation movement of the plunger into the recess of the cap housing.

2. Closure cap according to claim 1, wherein said membrane is piercable.

3. Closure cap according to claim 1, wherein the bottom edge of the skirt of the plunger has a nose which abuts against a raised edge of the top edge of the outer sleeve in the first, non-active position and engages in an indentation formed by the top edge of the outer sleeve in the second, activated position.

4. Closure cap according to claim 3, wherein at the level of the indentation a vertically extending groove is in an outside wall of the cylindrical recess of the cap housing, in which groove a projection formed on the inside surface of the nose is able to engage when the nose is located above the indentation.

5. Closure cap according to claim 1, wherein a guide pin, which engages in a guide groove recessed in the skirt of the plunger, is provided on an outside wall of the cylindrical recess.

6. Closure cap according to claim 1, wherein the bottom edge of the lateral surface forms at least one point which is directed toward the membrane.

7. Closure cap according to claim 6, wherein a wedge-shaped projection, which interacts with a projection provided on the top surface of the membrane when the plunger is pressed down in the direction of the membrane, is formed on the inside surface of the lateral surface in order to facilitate the folding back of the membrane which is perforated by the bottom edge of the lateral surface.

8. Closure cap according to claim 1, wherein the cap housing has an internal thread for detachably fastening the closure cap on a container neck.

9. Closure cap according to claim 8, wherein a ribbing is provided on the outside surface of the cap housing for the easier unscrewing of the closure cap from the container neck.

10. Closure cap according to claim 8, wherein the closure cap is connected to a locking ring by means of several thin webs, wherein the webs are broken when the closure cap is unscrewed from the container neck and the locking ring remains on the container neck.

11. Closure cap according to claim 1, wherein the cap housing is comprised at least in part of a transparent or translucent material.

12. Closure cap according to claim 1, wherein the chamber is filled with a substance.

13. Closure cap according to claim 1, wherein the cap housing and the plunger are each formed as an integral moulded part.

14. A container comprising a closure cap according to claim 1.

* * * * *